United States Patent [19]

Ratcliffe et al.

[11] Patent Number: 4,761,162

[45] Date of Patent: Aug. 2, 1988

[54] UPGRADING AND STORAGE OF SOLID CARBONACEOUS FUEL

[75] Inventors: Charles T. Ratcliffe, LaHabra; Geoffrey E. Dolbear, Diamond Bar, both of Calif.

[73] Assignee: Union Oil Company of California, Los Angeles, Calif.

[21] Appl. No.: 916,866

[22] Filed: Oct. 9, 1986

[51] Int. Cl.[4] ..... C10L 9/08

[52] U.S. Cl. ..... 44/626; 44/608; 34/12

[58] Field of Search ..... 44/1 R, 1 G; 34/12

[56] References Cited

U.S. PATENT DOCUMENTS 4,213,752 7/1980 Seitzer ..... 432/14

4,396,394 8/1983 Li et al. ..... 44/1 G

OTHER PUBLICATIONS

Fuels and Their Combustion, Haslam and Russell, McGraw-Hill Book Co., Inc, New York (1926), Chapter IV, pp. 72–85.

L. E. Paulson, S. A. Cooley, and R. C. Ellman, "Shipment, Storage and Handling Characteristics of Dried Low-Rank Coals," U.S. Bureau of Mines Report IC 8650, 1974.

*Primary Examiner*—Carl F. Dees

*Attorney, Agent, or Firm*—Yale S. Finkle; Gregory F. Wirzbicki; Dean Sandford

[57] ABSTRACT

Solid carbonaceous fuel is dried to a desired moisture content, cooled, and stored in an atmosphere having a controlled humidity and oxygen content to prevent heat generation which causes spontaneous combustion. A suitable atmosphere is produced by displacing air in a storage enclosure with dehumidified combustion gases.

20 Claims, No Drawings

UPGRADING AND STORAGE OF SOLID CARBONACEOUS FUEL

INTRODUCTION TO THE INVENTION

This invention relates to the treatment of solid carbonaceous fuel, such as coal, to increase the caloric values of the fuel, and to the storage of treated fuel.

Solid carbonaceous fuels, such as coals, constitute an energy resource of enormous magnitude. In particular abundance on the North American continent are lower-ranked coals, i.e., those having relatively low heating values and classified as sub-bituminous, and lignite or "brown coal." These lower-ranked coals are also in demand, since they contain lesser amounts of sulfur than do the higher energy-containing bituminous coals or anthracite and, therefore, are more suitable fuels for electric power generating plants in urban areas which have strict air pollution standards. A disadvantage of the lower-ranked coals is their high moisture content, which can be greater than 50 percent by weight. This moisture content decreases the heating value of the coal, thus adversely affecting the selling price obtainable by a coal producer. Also, many users of the coal are located some distance from locations where the coal is mined, necessitating the expense of shipping large quantities of contained water, for which the users have no need. In fact, the users suffer a second penalty from the moisture content in that additional fuel consumption will be experienced in steam boilers and the like, reflecting energy required for vaporizing the moisture.

Because of these problems, it is frequently necessary to reduce the coil moisture content before shipping the coal to a user. Very low moisture contents can be obtained using a fluidized bed, suspension, rotary, or cascade dryer, which is heated with combustion gases; depending upon the customer's requirements and the expense which can be tolerated, coal with moisture contents as low as about 2 percent by weight can be readily produced. More typically, the coal is dried to contain less than about 10 percent by weight moisture, e.g., about 7 to 8 percent, which is an acceptable amount for steam boiler fuels, since dry coal tends to extract moisture from its environment to reachieve its inherent moisture level (i.e., the maximum water content at which the coal feels dry and does not have visible surface moisture), which is about 10 to 15 percent by weight water for many sub-bituminous coils and lignites in Western North America.

However, dried coals pose a very serious storage problem in that they tend to exhibit localized heating and spontaneous combustion since their rehydration reactions involving atmospheric moisture are exothermic, and since a certain amount of exothermic surface oxidation is continuously occurring. This spontaneous combustion occurs where the rate of heat generation exceeds the rate of heat dissipation from the coal. Coal has a very low heat capacity and a very low thermal conductivity, severely limiting the heat dissipation which can be achieved.

One method of preventing spontaneous combustion problems involves conversion of the coal to a higher carbon char material. U.S. Pat. No. 3,754,876 to Pennington et al. discloses a process in which coal is contacted with an inert, hydrogen-poor hydrocarbon fluid at temperatures of 650° F. to 1000° F. to simultaneously dry the coal and remove condensable and noncondensable gaseous products, and liquid products. The char so formed is cooled in contact with steam and is removed from the process at temperatures about 200° F. to 300° F. U.S. Pat. No. 4,170,456 to Smith teaches carbonizing coal at 1000° F., exposing the resulting char to air at 100° F. to 500° F., then contacting the char with carbon dioxide at 50° F. to 300° F. Both of these treatments are described as produding a stable, storable product, but require an expensive heating to fairly high temperatures.

Other workers have rendered dried coal less subject to spontaneous combustion by coating the dried coal with a material which prevents oxygen and moisture from entering the particles. Johnson, in U.S. Pat. No. 3,985,517, applies a coating of a heavy liquid hydrocarbon material after drying the coal in a fluidized bed. U.S. Pat. No. 4,504,274 to Anderson describes the drying of coal with hot coal char in a turbulent bed, and spraying the product with an oil, such as the oil described in U.S. Pat. No. 4,201,657 to Anderson et al. Such treatments suffer from the additional expenses of the coating materials and application costs.

SUMMARY OF THE INVENTION

Solid carbonaceous fuel is heated to separate contained water therefrom, cooled, and then stored in an atmosphere of nonoxidizing gases, or oxygen-depleted air, having a controlled relative humidity to prevent oxidation and spontaneous combustion. A particularly convenient source of oxygen-depleted air is the combustion gas which has been used to reduce the water content of the fuel.

DETAILED DESCRIPTION OF THE INVENTION

The present invention is a method for upgrading solid carbonaceous fuels, particularly high-moisture, relatively low heating value fuels such as sub-bituminous coal and lignite. This method is particularly applicable to fuels containing more than about 10 percent by weight water.

Carbonaceous fuel for treatment by the method of the invention can be obtained directly from a mine, or can be first subjected to various preparation steps, including size reduction and classification, and cleaning. Cleaning is done primarily to remove ash-forming materials and can include jig washing, heavy medium separations, trough or table washing, air current density separation, or froth flotation. Certain of these cleaning procedures leave the coal very wet, and will normally be followed by dewatering, such as draining on screens or centrifugation.

The carbonaceous fuel is dried to produce a desired moisture level, according to the requirements of purchasers. This drying is brought about by contacting the fuel with heated gases, typically gases produced by the combustion of a carbonaceous or hydrocarbon fuel in air. A variety of equipment is known in the art as useful for contacting, including several types of fluid bed dryers, belt dryers, cascade dryers, screen-type dryers, drum dryers, and others.

After the drying treatment, the carbonaceous fuel is cooled and transferred to a storage enclosure, such as a bunker or silo, for protection against weathering during the time it must be stored before shipment to the customer. A typical silo will have a lower section with sides sloping inwardly toward a relatively small opening which is used to unload the stored material; the silo can be generally conical in shape or can have a cylindrical upper portion and a conical lower portion. Generally, carbonaceous fuel is added to the top of the silo and is removed at the bottom.

Dried solid carbonaceous fuel can be safely maintained in storage enclosures, without localized heat evolution or spontaneous combustion, by providing an atmosphere within the enclosure which preferably contains less than about 3 volume percent oxygen when the relative humidity is less than about 50 percent. This condition can be established by purging the enclosure with an inert or other nonoxidizing gas (e.g., carbon dioxide, nitrogen, argon, and the like) or mixtures of such gaes or, more conveniently and less expensively, by purging with combustion gases such as those which are recovered from the dryer exhaust, steam boilers, and the like.

To augment these combustion gases, or as a replacement therefore, suitable gases can be produced by a separate, dedicated fuel burner or set of burners. Typically, such a burner will operate with coal, petroleum products, or natural gas fuels, and will have an objective of stoichiometic combustion to minimize the oxygen content of the produced gases. Burning a coal having the analyses of Table I in an air atmosphere can produce a gas mixture having the calculated composition of Table II. Alternatively, the combustion of methane in air can produce a gas mixture having the calculated composition of Table III.

TABLE I

| Typical Sub-bituminous Coal (Weight percentages - dry basis) | |
|---|---|
| Ash | 12.5 |
| Ash-free organic fraction: | |
| C | 76.8 |
| H | 5.2 |
| N | 1.6 |
| S | 0.6 |
| O (by difference) | 15.8 |

TABLE II

| Volume Percentages at 25° C. | |
|---|---|
| $N_2$ | 80.7 |
| $CO_2$ | 12.4 |
| $H_2O$ | 6.7 |
| $NO_2$ | 0.2 |
| $SO_2$ | 0.04 |

TABLE III

| Volume Percentages at 25° C. | |
|---|---|
| $N_2$ | 72.7 |
| $H_2O$ | 18.2 |
| $CO_2$ | 9.1 |

The exact gas composition will be dependent upon several factors, including the type of fuel used, the air-fuel ratio, combustion temperature, and others. In addition to the above-noted components, combustion gases can contain carbon monoxide, hydrogen, and other materials in minor amounts, depending upon combustion conditions and the nature of the particular fuels.

It is likely that the primary source of undesired heating in stored, dry coal is water readsorption due to the unstable nature of coal which has been dried at a low enough temperature (i.e, below about 600° F.) so as to preserve the original pore structure of the coal. Water readsorption can be represented by equation (1):

$$\text{Coal} + H_2O \rightarrow \text{Coal}\cdot H_2O \quad (1)$$

and will occur whenever air having a sufficiently high relative humidity is present with the coal. Thermodynamically, an equilibrium constant ($K_{eq}$) can be calculated if one knows the heat of adsorption of water on the coal surface, which is different for different coals. The equilibrium constant is represented by equation (2):

$$K_{eq} = \frac{[H_2O \text{ at coal adsorption sites}]}{[H_2O \text{ in air}]} \quad (2)$$

and would be calculated from equation (3):

$$\Delta G \text{ of Coal}\cdot H_2O - \Delta G \text{ of } H_2O = RT\,(\ln K_{eq}) \quad (3)$$

Added to the heat of water adsorption is the relatively large heat of water condensation (540 calories per gram), which also must be dissipated by the coal.

It is believed that coal oxidation becomes a problem only after the coal has been heated by water adsorption. At moderate temperatures, only a small number of sites at the surface of a coal particle are susceptible to air oxidation and, when oxidation has occurred, the sites are deactivated until an endothermic desorption of oxidation products (i.e., carbon dioxide or carbon monoxide) occurs. At temperatures below about 170° F. this desorption proceeds very slowly, limiting the rate of coal oxidation such that it cannot be self-sustaining. The oxidation rate increases above about 200° F. and again above about 300° F., where the oxidation can be self-sustaining if sufficient oxygen is present.

As previously mentioned, rehydration of dried carbonaceous fuel is one possible cause of undesired heating during storage. Accordingly, combustion gases normally must be treated to remove at least a portion of their contained water before coming into contact with dried fuel. This can be accomplished using a number of techniques, including passing the gases through a bed of solid absorbent material (such as alumina, molecular sieve, silica gel, and the like) which can be regenerated by heating, after its moistureremoving capacity is reached.

In addition to moisture removal, the combustion gases should be subjected to cooling, preferably to temperatures below those of the stored carbonaceous fuel and, more preferably, to about the ambient air temperature. Frequently this cooling will result simply from passing the gases through uninsulated ducting and will not require additional equipment.

In many cases, water removal from the gases using adsorbent materials will be prohibitively expensive, in which case condensation of the water from the gases will be a preferred method. Condensation can be effected by contacting the gases with a cooled surface, which cooling can be achieved by jacketing the surface and passing a fluid having a desired temperature through the jacket. Temperatures of the fluid (e.g., water or air) can be adjusted by chillers and many other means known in the art.

Since rehydration is believed to be the primary cause of undesired heating, high levels of oxygen (e.g. 10 volume percent or more) can probably be tolerated in the purge gases, provided that the gases are very dry and there are no pre-existing "hot spots" in the stored carbonaceous fuel.

It is normally not necessary to remove all moisture from the gases; only enough must be removed so that the dried fuel will not absorb significatnt amounts of moisture. Thus, the oxygen-depleted gases need only be dehumidified to a particular relative humidity, which can be readily determined for a given fuel and drying state by a simple experiment. Typically, the gases will be dehumidified to levels less than about 50 percent relative humidity.

In the simple experiment, two streams of a substantially oxygen-free gas (e.g, nitrogen, or carbon dioxide, or a mixture of such gases) are used: one stream is maintained in a dry condition (zero relative humidity), while the other is bubbled through water, at ambient temperature (100 percent relative humidity); the streams can be blended in any desired proportions, using flow meters, to produce various relative humidities. A smaple of thoroughly dried fuel is exposed to selected conditions of relative humidity, for sufficient times to establish equilibration, and weight increases are noted. Analysis of the data obtained will indicate a maximum relative humidity for a given desired moisture content in the fuel.

As an example of the experiment, a sample of pulverized coal having an analysis as summarized in Table I is dried at 100° C. for 2 hours. This dried coal is exposed at 25° C. to nitrogen gas of varying relative humidities produced by mixing two nitrogen streams as discussed above. Moisture content of the coal is determined at various increasing humidity levels by measuring the weight increase of the sample for each level of humidity. Results are summarized in Table IV, and show that, for example, this coal can be dried to a moisture content of 8 weight percent and then stored safetly in gases having relative humidities less than about 6 percent. A similar experiment should be conducted for each different fuel.

TABLE IV

| Relative Humidity | Water in Coal, Weight Percent |
|---|---|
| 0 | 1.3 |
| 24 | 4.3 |
| 54 | 7.3 |
| 86 | 9.9 |
| 100 | 11.6 |

The dried, cooled gases are used to purge a storage enclosure and dried solid carbonaceous fuel contained therein. This will be most efficiently accomplished when gases are introduced at a lower elevation in the enclosure and are vented at one or more locations toward the top of the enclosure. Rising oxygen-depleted gases will displace oxygen- and water-containing air present in the enclosure, including that air which may enter the enclosure while carbonaceous fuel is being loaded into, or removed from, the enclosure.

As an alternative method for introducing gas, or as a method for rapidly establishing a reduced oxygen atmosphere, solid or liquid carbon dioxide (or other liquified gases) can be mixed with the carbonaceous fuel as it is loaded into a storage enclosure. If, after filling, the enclosure is well sealed, it may not be necessary to further purge with gases as is hereinbefore described.

While the preceding description has focused upon combustion and other less expensive gases, there are instances where other gases, such as halogenated hydrocarbons (including fluorocarbon and chlorofluorcarbon "Freons") can be used to provide a suitable storage atmopshere. Due to the high cost for such gases, it will normally be necessary to recirculate as much gas as possible and seal the storage enclosure to minimize losses of gas. Of course, as the gas passes through stored carbonaceous fuel, a certain amount of moisture and oxygen could be picked up; undesired amounts of moisture can be removed as previously described for combustion gases, while undesired amounts of oxygen can be removed by adsorption with molecular sieves, reaction with reducing agents, or other methods known in the art. It will occasionally be economically beneficial to recirculate even the less expensive gases, as where fuel is burned specifically to provide purge gas; control of moisture and oxygen content should be accomplished as with the more expensive gases.

Effectiveness of the low-oxygen and low-moisture atmosphere in preventing spontaneous combustion can be determined by the temperature stability of purge gases exiting the storage enclosure: if the temperature increases, relative to the inlet gas temperature, the flow rate should be increased to more effectively displace oxygen and moisture from the stored fuel. Alternatively, or in addition to temperature measurements, the exiting gases can be analyzed (e.g, by gas chromatography) to determine the concentration of carbon monoxide which is being desorbed from oxidation sites on the carbonaceous fuel.

Various embodiments and modifications of this invention have been described in the foregoing discussion and further modifications will be apparent to those skilled in the art. Such modifications are included within the scope of the invention, as defined by the following claims.

What is claimed is:

1. A method for upgrading and storing coal which comprises:
   (a) heating said coal to reduce the moisture content to a chosen value, thereby producing a dried coal;
   (b) determining a maximum relative humidity which will preserve said chosen moisture content in said dried coal;
   (c) dehumidifying combustion gases to produce a relative humidity less than the maximum determined in step (b); and
   (d) providing an atmosphere comprising said dehumidified combustion gases about said dried coal.

2. A method as defined by claim 1 wherein said coal initially contains greater than about 10 weight percent water.

3. A method as defined by claim 1 wherein said coal is heated by contacting said coal with hot gases in a drying zone.

4. A method as defined by claim 3 wherein the combustion gases that are dehumidified comprise said hot gases with which said coal has been contacted in step (a).

5. A method as defined by claim 4 wherein said hot gases are dehumidified by cooling.

6. A method as defined by claim 1 wherein said chosen value for the moisture content of said dried coal is less than about 8.0 weight percent and the relative humidity of said dehumidified combustion gases is less than about 50 percent.

7. A method for upgrading and storing a solid carbonaceous fuel which contains at least about 10 weight percent moisture comprising:

(a) contacting said solid carbonaceous fuel in a drying zone with hot gases produced by the combustion of a hydrocarbon fuel in air under conditions such that the moisture content of said solid carbonaceous fuel is reduced;

(b) cooling said heated solids from step (a);

(c) passing said cooled solids to a storage enclosure; and (d) purging said storage enclosure with a gas containing less than about 10 volume percent oxygen and having a relative humidity of less than about 50 percent.

8. A method as defined by claim 7 wherein said solids carbonaceous fuel comprises coal.

9. A method as defined by claim 7 wherein the moisutre content of said solid carbonaceous fuel is reduced to below about 8.0 weight percent in step (a).

10. A method as defined by claim 7 wherein said storage enclosure comprises a silo.

11. A method as defined by claim 7 wherein said gas containing less than about 10 volume percent oxygen and having a relative humidity of less than about 50 percent is selected from the group consisting of nitrogen, carbon dioxide, argon, halogenated hydrocarbons and mixtures thereof.

12. A method as defined by claim 7 wherein said gas containing less than about 10 volume percent oxygen and having a relative humidity of less than about 50 percent comprises combustion gases.

13. A method as defined by claim 12 wherein said storage enclosure is purged with combustion gases containing less than about 3.0 volume percent oxygen.

14. A method as defined by claim 12 wherein said combustion gases comprise the hot gases with which said solid carbonaceous fuel has been contacted in step (a), said hot gases having been treated to remove moisture.

15. A method as defined by claim 12 wherein said combustion gases are substantially free of oxygen.

16. A method for upgrading and storing coal which contains at least about 10 weight percent water comprising:

(a) contacting said coal in a drying zone with hot gases produced by the combustion of a carbonaceous or hydrocarbon fuel in air under conditions such that the water content of said coal is reduced;

(b) cooling the heated coal from step (a);

(c) passing said cooled coal to a storage enclosure;

(d) treating the hot gases exiting said drying zone to cool said gases and to remove a sufficient amount of water such that the cooled gases will have a relatively humidity less than about 50 percent; and (e) purging said storage enclosure with the cooled gases from step (d), wherein said cooled gases contain less than about 10 volume percent oxygen.

17. A method as defined by claim 16 wherein said cooled gases contain less than about 3.0 volume percent oxygen.

18. A method as defined by claim 16 wherein said water is removed from said hot gases in step (d) by cooling said gases.

19. A method as defined by claim 16 wherein said coal comprises lignite.

20. A method as defined by claim 16 wherein said coal comprises subbituminous coal.

* * * * *

UNITED STATES PATENT AND TRADEMARK OFFICE

CERTIFICATE OF CORRECTION

PATENT NO. : 4,761,162
DATED : 08/02/88
INVENTOR(S) : Charles T. Ratcliffe, Geoffrey E. Dolbear It is certified that error appears in the above-identified patent and that said Letters Patent is hereby corrected as shown below:

On the title page at "[56] References Cited" the following U.S. Patent documents should be listed:

| | | | |
|---|---|---|---|
| 3,754,876 | 8/1973 | Pennington et al. | 44/1 |
| 3,985,517 | 10/1976 | Johnson | 44/1 |
| 4,170,456 | 10/1979 | Smith | 44/1 |
| 4,201,657 | 5/1980 | Anderson et al. | 208/23 |
| 4,504,274 | 3/1985 | Anderson | 44/6 |

Signed and Sealed this

Twenty-fourth Day of July, 1990

*Attest:*

HARRY F. MANBECK, JR.

*Attesting Officer*

*Commissioner of Patents and Trademarks*